US006186248B1

(12) United States Patent
Silay et al.

(10) Patent No.: US 6,186,248 B1
(45) Date of Patent: Feb. 13, 2001

(54) CLOSED LOOP CONTROL SYSTEM FOR DIAMOND CORE DRILLING

(75) Inventors: Louis E. Silay, Twain Harte; Raymond B. McKinley, Ballico, both of CA (US)

(73) Assignee: Boart Longyear Company, Oakdale, CA (US)

( * ) Notice: Under 35 U.S.C. 154(b), the term of this patent shall be extended for 0 days.

(21) Appl. No.: 09/209,821

(22) Filed: Oct. 22, 1998

Related U.S. Application Data

(63) Continuation-in-part of application No. 09/017,616, filed on Feb. 2, 1998, now abandoned, which is a continuation-in-part of application No. 08/567,184, filed on Dec. 12, 1995, now Pat. No. 5,794,723.

(51) Int. Cl.[7] ..... E21B 3/06; B23Q 5/00

(52) U.S. Cl. ..... 175/27; 175/24; 173/2; 173/11

(58) Field of Search ..... 175/24, 27; 173/2, 173/5, 6, 11

(56) References Cited

U.S. PATENT DOCUMENTS

| | | | | |
|---|---|---|---|---|
| 1,935,105 | | 11/1933 | Woollen . | |
| 2,314,560 | | 3/1943 | Scharpenberg | 255/19 |
| 2,455,917 | | 12/1948 | Crake | 255/19 |
| 2,626,127 | | 1/1953 | Crookston | 255/19 |
| 2,650,796 | | 9/1953 | Abraham | 255/19 |
| 2,669,871 | | 2/1954 | Lubinski . | |
| 3,039,543 | | 6/1962 | Loocke | 175/26 |
| 3,550,959 | | 12/1970 | Alford . | |
| 3,581,564 | | 6/1971 | Young, Jr. . | |
| 3,653,636 | * | 4/1972 | Burrell | 254/173 |
| 3,658,138 | | 4/1972 | Gosselin | 173/1 |
| 3,774,445 | | 11/1973 | Rundell et al. . | |
| 3,782,190 | | 1/1974 | Pittman . | |
| 3,866,696 | * | 2/1975 | Larralde et al. | 175/27 X |
| 3,870,111 | | 3/1975 | Tuomela et al. . | |
| 3,872,932 | | 3/1975 | Gosselin | 173/1 |
| 3,912,227 | * | 10/1975 | Meeker et al. | 175/27 X |
| 3,971,449 | | 7/1976 | Nylund et al. . | |
| 4,165,789 | | 8/1979 | Rogers . | |
| 4,354,233 | * | 10/1982 | Zhukovsky et al. | 173/6 X |
| 4,354,558 | | 10/1982 | Jageler et al. . | |
| 4,396,074 | | 8/1983 | Jageler et al. . | |
| 4,434,971 | * | 3/1984 | Cordrey | 173/11 X |
| 4,491,186 | * | 1/1985 | Alder | 175/27 X |
| 4,662,608 | | 5/1987 | Ball . | |
| 4,714,119 | | 12/1987 | Hebert et al. . | |
| 4,793,421 | | 12/1988 | Jasinski | 175/27 |
| 4,825,962 | * | 5/1989 | Girault | 173/2 X |
| 4,854,397 | * | 8/1989 | Warren et al. | 175/27 X |
| 4,875,530 | | 10/1989 | Frink et al. . | |
| 4,926,686 | | 5/1990 | Fay . | |
| 4,962,817 | * | 10/1990 | Jones et al. | 175/27 X |
| 5,138,875 | | 8/1992 | Booer . | |
| 5,305,836 | | 4/1994 | Holbrook et al. . | |
| 5,388,649 | | 2/1995 | Ilomaki . | |
| 5,449,047 | | 9/1995 | Schivley, Jr. . | |
| 5,474,142 | | 12/1995 | Bowden . | |
| 5,501,285 | | 3/1996 | Lamine et al. . | |
| 5,704,436 | | 1/1998 | Smith et al. . | |
| 5,713,422 | * | 2/1998 | Dhindsa | 175/27 |
| 5,794,721 | * | 8/1998 | Clonch et al. | 175/45 |
| 5,794,723 | * | 8/1998 | Caneer, Jr. et al. | 175/85 |
| 5,927,408 | * | 7/1999 | Dummer et al. | 175/27 |

* cited by examiner

*Primary Examiner*—Eileen D. Lillis
*Assistant Examiner*—Jong-Sak Lee
(74) *Attorney, Agent, or Firm*—Christie, Parker & Hale, LLP

(57) ABSTRACT

A closed loop control system for a core drilling mechanism automatically controls the penetration rate, the weight on the drill bit, and the torque load applied to the drill string, and maintains all three at or below preselected maximum values. The closed loop control system incorporates a controller that receives sensed information and generates corresponding control signals to control the penetration rate and thus the weight on the drill bit and the torque load through a servo valve in a hydraulic drive circuit. One or more sensors are provided to sense the penetration rate of the drill bit, and are coupled with the controller. Similarly, sensors are provided to determine the weight on the drill bit and the torque load applied to the drill string.

10 Claims, 8 Drawing Sheets

CLOSED LOOP CONTROL SYSTEM FOR DIAMOND CORE DRILLING

CROSS-REFERENCE TO RELATED APPLICATIONS

This is a continuation-in-part application of U.S. Patent application Ser. No. 09/017,616, filed on Feb. 2, 1998, now abandoned, which is a continuation-in-part application of U.S. Patent application Ser. No. 08/567,184, filed on Dec. 12, 1995, and now U.S. Pat. No. 5,794,723, issued on Aug. 18, 1998.

FIELD OF THE INVENTION

The present invention relates to closed loop control systems for monitoring the conditions of a working machine and for automatically modifying those conditions as necessary. More particularly, the present invention relates to such control systems that simultaneously and continually sense the load applied to a core drilling bit carried by a drill string, the rate at which the drill bit is advanced or retracted, and the torque load applied to the drill string, with the control automatically switching between the respective sensed variables as drilling conditions change to keep the weight on the bit, the rate of penetration, and the torque load on the drill string within pre-set ranges of values.

BACKGROUND OF THE INVENTION

Core drilling is a widely employed method for inspecting earth formations deep below the surface. The typical method involves drilling a borehole on the order of a few inches in diameter, and obtaining one or more core samples. The cores are stored in the coring device and may be studied after the device is removed from below the surface.

One popular type of drill bit used in core drilling is a diamond bit, which includes a matrix to which is affixed a plurality of diamonds. The bit is rotated at high speeds and is advanced downwardly in order to create a cylindrical borehole. The drill bit is typically annular to define a central opening. Thus, as the drill bit is advanced through the earth, a portion of the earth is forced through the central opening. In this manner, a core sample is obtained and stored for later inspection.

While diamond drill bits are efficient when used properly, there are a number of shortcomings associated with those bits as well. When using diamond drill bits, the weight on the bit is of critical importance. If too little weight is applied to a bit, then the rock in contact with the rotating bit tends to polish the diamonds, such that they become much less efficient in cutting through the rock. On the other hand, if too much weight is applied to the bit, diamonds tend to be stripped from the matrix, thereby destroying the bit. In either event, the operator must replace the bit, which is not only expensive, but can be very time-consuming as the drill string must be raised and dismantled piece-by-piece before access can be had to the bit. In the case of a drill string hundreds of feet long, with each drill string segment being 10 to 20 feet long, such a procedure is time-consuming and extremely inefficient.

Many prior art systems simply rely on the operators' expertise in order to prevent damage to the drill bits. Those systems include support/feed hydraulics to control advancement of the drill bit, and also incorporate pressure gauges that monitor the pressure in the hydraulic system. Thus, the operator must monitor the pressure gauge and use that information to estimate the actual weight applied to the bit.

To further complicate matters, these prior art systems operate in two modes, a "pull down" mode and a "hold back" mode. In the "pull down" mode, the hydraulic system actually forces the bit downwardly through the earth. In the "hold back" mode, the hydraulic system takes weight off of the drill string and thus the drill bit. In the "pull down" mode, the weight on the drill bit is determined by reading the pressure gauge in a straightforward manner. However, in the "hold back" mode, the pressure gauge must be read in reverse to estimate the weight on the drill bit. Thus, it is apparent that such systems require an experienced, attentive operator who can perform these estimations virtually instantaneously in his or her head. Any operator error or a momentary lapse of attention can result in destruction of the drill bit which, as described above, results in a costly and time-consuming replacement procedure.

A feedback control loop for a core drilling system is disclosed in U.S. Pat. No. 4,714,119 to Hebert et al. The system includes a core drilling mechanism that can be rotated from a vertical to a horizontal position in order to obtain a core sample from a side wall of a pre-drilled borehole. The system includes a feedback loop that controls the weight on the bit. The feedback loop operates in response to the back pressure on the coring motor to manipulate a needle valve in the hydraulic circuit. Thus, as resisting torque increases, the back pressure increases. In response, the feedback controller slows the forward movement of the coring bit. This system is not concerned with or suitable for use in solving the problem of the entire string weight being applied to a vertically moving drill bit. When a drill bit stops penetrating or slows down considerably, it can be due to a mismatch between the bit and the rock, or due to a dull bit. Neither of these scenarios necessarily result in an increase in the back pressure in the motor circuit. Thus, this prior art system would be wholly ineffective in such situations and would not prevent drill bit damage. Furthermore, this system does not monitor the weight on the bit, but simply monitors whether the head resists rotation, which could happen if, for example, the drilled hole were to collapse. This is quite possible, especially in a horizontal drill hole. Thus, this prior art system addresses different problems and is not suitable for use in solving the problems addressed by the present invention.

A number of prior art systems used in the oil drilling art include feedback systems for controlling weight-on-bit by slowing down, or stopping, the penetration of the drill bit. Examples are U.S. Pat. No. 4,875,530 to Frink et al. and U.S. Pat. No. 5,474,142 to Bowden. These references fail to provide any means for controlling the penetration rate, aside from reducing or zeroing out the penetration rate in the event the weight-on-bit exceeds the preset limit. Thus, these references do not provide a penetration rate feedback control, and are clearly not concerned with drilling at an optimal penetration rate.

Diamond core drilling typically involves relatively light-weight tubing for the drill string, unlike oil well drills, auger drills, rotary percussive drills, and the like, which use much heavier-weight tubing. Thus, a significant concern in the case of diamond core drilling is that the drill string will be subjected to excessive torque loads and will twist off. Often, these torque loads are reached well before the drill bit is subjected to the maximum weight-on-bit that it can handle.

Accordingly, it will be apparent to those skilled in the art that there continues to be a need for a control system for automatically controlling the weight applied to a core drill bit, the torque load applied to the drill string, and the penetration rate of the drill bit, and for maintaining all three within preset ranges. Furthermore, there exists a need for such a control system that simultaneously prevents both the drill bit and drill string from being damaged and optimizes the efficiency of the drilling system. The present invention addresses these needs and others.

SUMMARY OF THE INVENTION

Briefly, and in general terms, the present invention provides a closed loop control system for core drilling that automatically controls the penetration rate of the drill bit, the torque load applied to the drill string, as well as the weight on the drill bit, and maintains all three within preselected maximum values, while at the same time optimizing the rate of penetration of the drill bit. The closed loop control system of the present invention incorporates a controller that receives sensed information and generates corresponding control signals to control the penetration rate, and thereby indirectly control both the weight on the drill bit and the torque load on the drill string. One or more sensors are provided to sense the penetration rate of the drill bit, and are coupled with the controller. Similarly, one or more sensors are provided to determine the weight on the drill bit and the torque load on the drill string. The controller is programmed with preselected penetration rate, torque load, and weight-on-bit maximum values.

Initially, the system controls advancement of the bit in a closed loop fashion to maintain the drill bit operating at a preselected penetration rate as it monitors the weight-on-bit and torque load. If the weight-on-bit exceeds a preselected weight-on-bit maximum, the controller automatically controls the drive system to reduce the penetration rate and thereby reduce the weight on the drill bit. As drilling continues, if the weight-on-bit should happen to drop below the preselected maximum, the controller then controls the drive system to increase the penetration rate until it returns to the preselected value, all the while monitoring the weight-on-bit to ensure that it does not exceed the preselected maximum value. Similarly, the controller monitors the torque load on the drill string, ensuring that the torque load does not exceed the preselected maximum value, while simultaneously optimizing the penetration rate.

Thus, the closed loop control system of the present invention in one preferred embodiment comprises: a first sensor that is operative to sense one of the rate of penetration of a drill bit, the weight on the drill bit, and the torque load on a drill string, and to generate a corresponding first signal; a second sensor that is operative to sense one of the rate of penetration of the drill bit, the weight on the drill bit, and the torque load on the drill string, and to generate a corresponding second signal; and a controller in electrical communication with the respective sensors and in communication with a drive system, the controller being programmed with preselected maximum values for the weight on the drill bit, the rate of penetration, and the torque load, the controller being responsive to one of the signals having a value above the maximum value to control the drive system to reduce the rate of penetration of the drill bit.

In yet another embodiment, the method of the present invention comprises the steps of: sensing at least two of the weight on the drill bit, the rate of penetration of the drill bit, and the torque load applied to the drill string; determining whether at least one of the sensed weight, rate of penetration, and torque load exceeds a preselected maximum value for, respectively, the weight, rate of penetration, and torque load; and reducing the rate of penetration if at least one of the sensed weight, rate of penetration, and torque load exceeds the preselected maximum value.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENT

Figure 1:
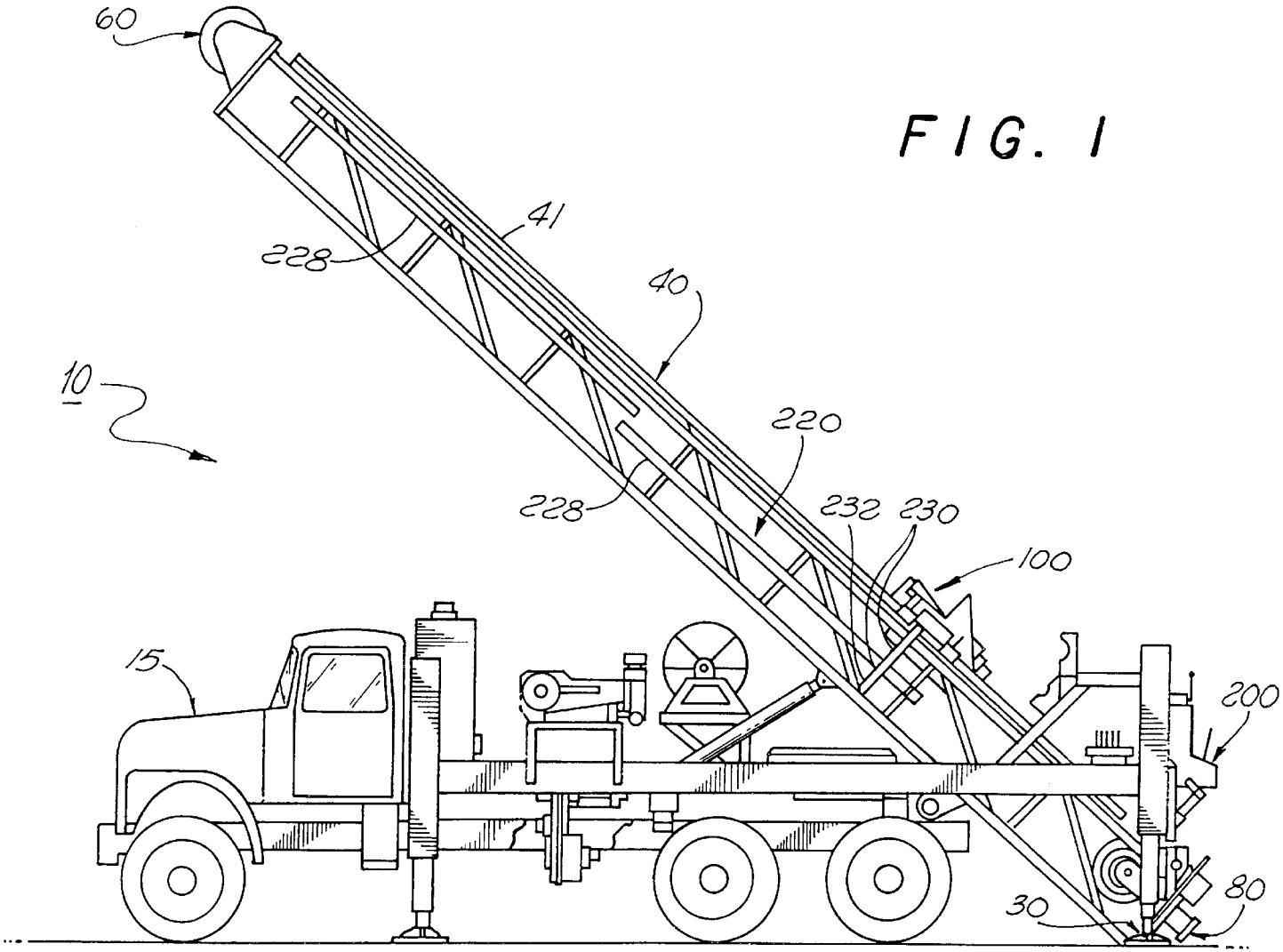
FIG. 1 is a side view of a rig with a core drilling mechanism mounted thereon.
Figure 2:
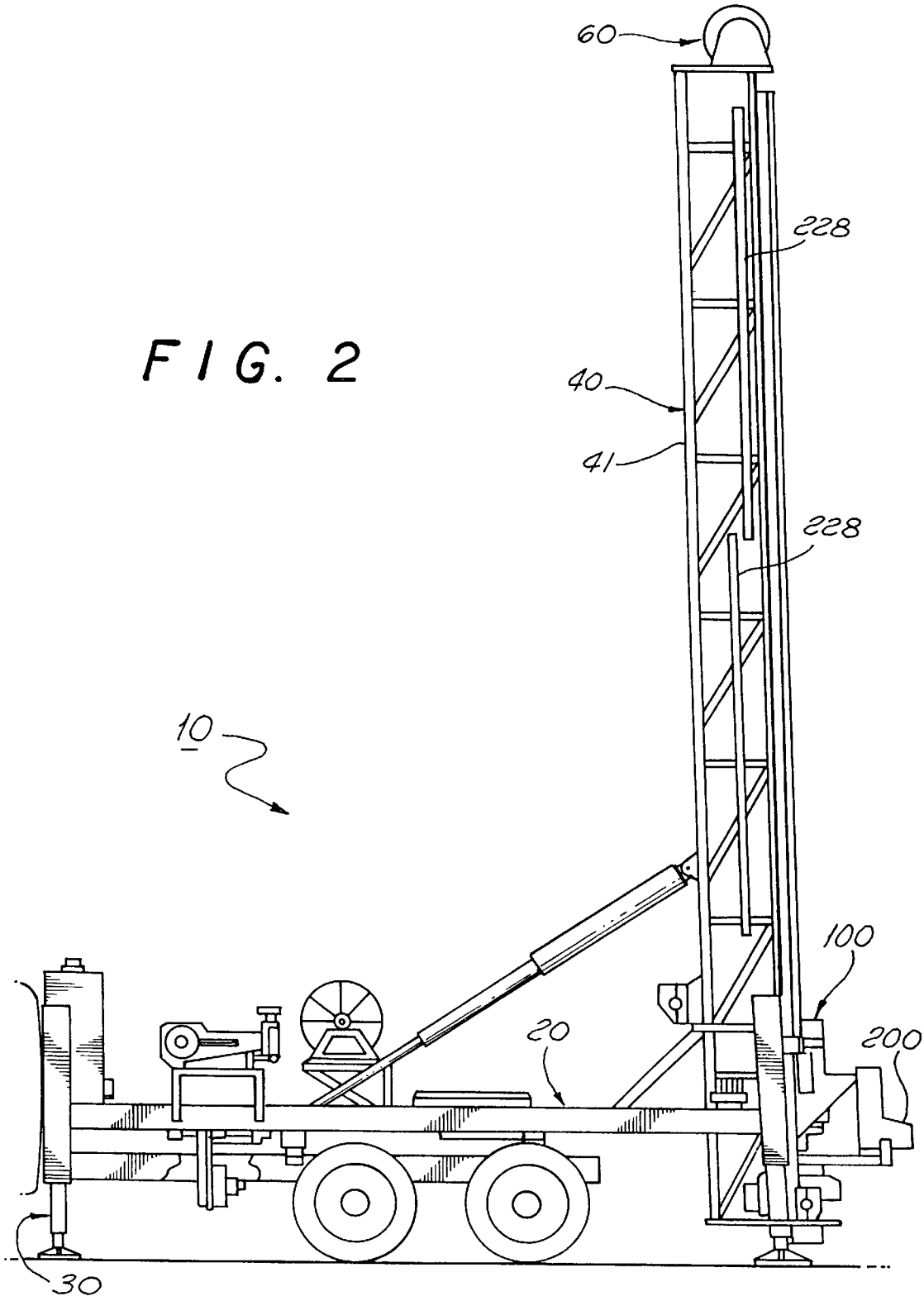
FIG. 2 is a fragmented side view of the rig of FIG. 1 with the core drilling mechanism in an upright, vertical position.
Figure 3:
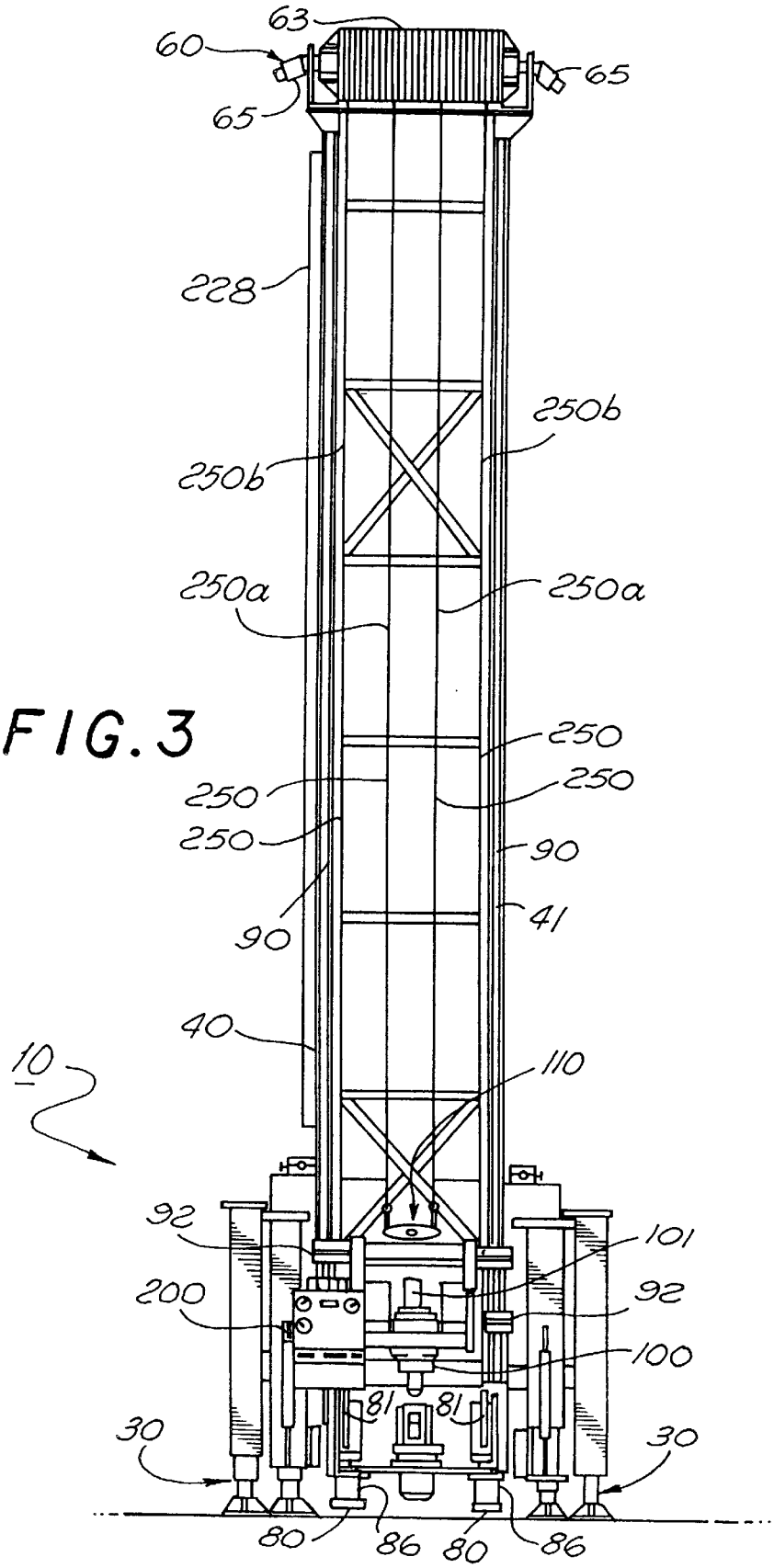
FIG. 3 is a rear plan view of the core drilling mechanism of FIG. 2.

In the following detailed description, like reference numerals will be used to refer to like or corresponding elements in the different figures of the drawings. Referring now to the drawings, and particularly to FIGS. 1 through 3, there is shown, generally, a core drilling mechanism 10 that incorporates a closed loop control system 12 comprising a preferred embodiment of the present invention. The core drilling mechanism is intended to illustrate one embodiment of a core drilling mechanism with which the closed loop control system of the present invention may be utilized, and thus is shown merely for illustrative purposes and is not intended to limit the invention in any way. The core drilling mechanism is described in co-pending U.S. patent application Ser. No. 08/567,184, assigned to Boart Longyear Company, the assignee of all rights in the present invention. The disclosure of application Ser. No. 08/567,184 is incorporated herein by reference. Briefly, the core drilling mechanism of the cited and incorporated application includes a frame 20, plural pad assemblies 30, a mast assembly 40, a hoist assembly 60, a pair of sheave groups 80, and a drillhead group 100. The core drilling mechanism in one embodiment is mounted to a truck 15 for transport to and from a drill site. The mast assembly may be pivoted between upright and retracted or partially retracted positions (FIGS. 1 and 2).

Figure 4:
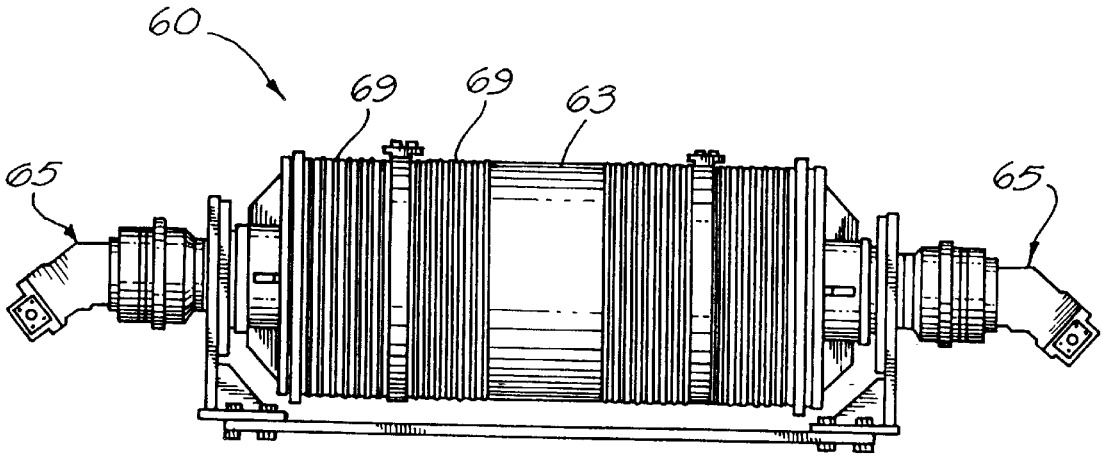
FIG. 4 is a front view of a hoist assembly included in the core drilling mechanism of the present invention.

The hoist assembly 60 is mounted on top of the mast assembly 40 and includes a pair of hydraulic motors 65 on opposite ends of a drum 63 (FIG. 4). The motors operate to rotate the drum in either a clockwise or counterclockwise direction. Four cables 250 wrap around the drum in grooved portions 69 and extend downwardly from the drum to the drillhead assembly 100. The cables are wound such that the two central cable windings 250*a* extend downward from the front of the drum, while the outer cable windings 250*b* extend downward from the back of the drum. Thus, upon rotation of the drum in a first direction, the central cables are wound onto the drum and the outer cables are let out (the "hold back" mode, as described in greater detail below). If the direction of rotation of the drum is reversed, the central cables are let out and the outer cables are wound onto the drum (the "pull down" mode).

The "pull-down" mode is required when the length of the drill string 101 is relatively short, and thus when the drill string is not heavy enough to apply sufficient weight on the drill bit. Thus the "pull-down" mode actually forces the drillhead assembly 100 downwardly to increase the weight on the bit. The "hold back" mode is entered when the drill string is heavy enough (or too heavy) to create sufficient (or too much) weight on the drill bit by itself.

Figure 5:
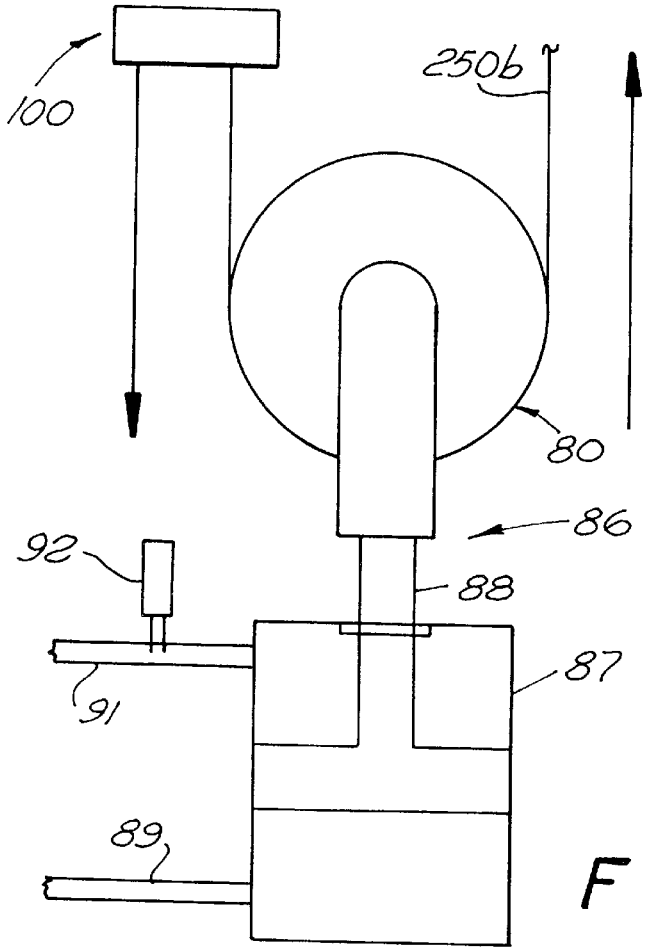
FIG. 5 is a schematic view of a lower tensioner assembly and sheave assembly included in the core drilling mechanism.

The sheave groups 80 are housed within the mast assembly 40 at the opposite end from the hoist assembly 60 and on either side of the mast 41. Sheaves 81 of the sheave groups 80 receive the respective outer cables 250*b*, which run on the sheaves 81 and then connect to the bottom of the drillhead assembly 100. A pair of bottom cable tensioner assemblies 86 mount the sheave assemblies to the mast. The tensioner assemblies include respective hydraulic cylinders 87 and pistons 88, as well as a pair of fluid conduits 89 and 91. As shown in FIG. 5, the piston partitions the cylinder into a pair of compartments which communicate with the respective fluid conduits. Thus, it will be apparent that by feeding fluid to or drawing fluid from one of the compartments, the piston is driven accordingly and thus pulls or pushes the corresponding sheave to cause the associated outer cable 250*b* to be in tension.

A pressure transducer 92 is connected for communication with the upper conduit 91 to sense the pressure in the upper compartments of the hydraulic cylinders. The pressure transducer is used to determine the weight-on-bit during the "pull-down" mode. As the hoist 60 is rotated to draw the outer cables 250*b* upwardly, the cables 250*b* and sheaves 81 act to pull the drillhead assembly 100 downwardly, which causes an increase in the weight-on-bit and exerts an upward force on the sheaves 81. The piston 88 is thus forced upwardly such that the oil pressure in the compartment above the piston head rises, and is sensed by the pressure transducer. This increased pressure is interpreted to ascertain the weight-on-bit, as described in greater detail below. The drillhead assembly 100 includes an electronic load cell assembly 110 and a drive motor assembly (FIG. 3). The drillhead assembly travels vertically along rails 90 located on the outside of the mast 41 and is driven by the hoist 60. The central cables 250*a* are attached to the drillhead assembly via a pair of bolt eyes formed on the load cell assembly (FIG. 3). The drive motor assembly comprises a pair of conventional hydraulic drive motors (not shown) that are engaged to the drillhead assembly and are driven by the hydraulic system of the device to rotate the drillhead assembly and thus the drill bit mounted thereon. In the "hold back" mode, the hoist 60 is rotated in a direction such that the inner cables 250*a* are wound on the drum 63. This supports a portion of the combined weight of the drillhead 100, drill string 101, and drill bit that otherwise would be exerted on the face of the bit. In this mode, the load cell 110 senses the weight on the bit and generates a corresponding electrical signal, as described in greater detail below.

The closed loop control system 12 includes, in a preferred embodiment, the load cell 110, the pressure transducer 92, a linear displacement transducer assembly 220, a controller 222 in communication with the transducers and load cell, a servo amplifier 224, and a servo valve 226 in the hydraulic circuit feeding the drive motors 65. The controller preferably comprises a programmable logic controller (PLC), such as Model Number SLC 500 PLC from the Allen Bradley Company. The controller can also comprise a personal computer or other computing entity with the proper programming, as described in greater detail below.

As shown in FIGS. 1 and 2, the linear displacement transducer assembly 220 includes, in a preferred embodiment, a pair of horizontally offset, vertically extending linear transducers 228 contained within housings that are mounted on the mast 41 at different heights. The linear transducer assembly further includes a pair of offset magnetic elements 230 carried by an arm 232 mounted to the drillhead assembly. Thus, as the drillhead assembly 100 moves vertically, one of the magnetic elements will be aligned with the corresponding sensing transducer and the relative movement of the magnetic element is sensed by the transducer and a corresponding electrical signal is generated. In one embodiment, the linear displacement transducer assembly 220 comprises a pair of transducers, model number BTL-2-All-3606-PKA05 from Balluff Company. It will be apparent that many types of linear displacement transducers may be used, including those that incorporate potentiometric resistance elements, and the like. In addition, rotary transducers can also be used to determine the penetration rate of the drill bit.

The servo amplifier 224 comprises a conventional amplifier such as model number 23-5030 from Dynamic Valves, Inc. The servo amplifier receives a control signal from the controller 222 and generates an error signal that is transmitted to the servo valve. The control signal results when either a process variable (the penetration rate or weight-on-bit) exceeds the preselected maxima, or when the preselected maxima are changed by the operator through an I/O device 236, as described in greater detail below. The servo valve 226 is responsive to the error signal to either increase or decrease the penetration rate of the drill bit. The servo valve includes a pair of output ports, each of which feed the motors 65 to rotate in a different direction.

Thus, depending on the signal received by the servo valve, fluid is fed to one of the ports of the motors to cause the drum to rotate in either a clockwise or counterclockwise direction.

Figure 6:
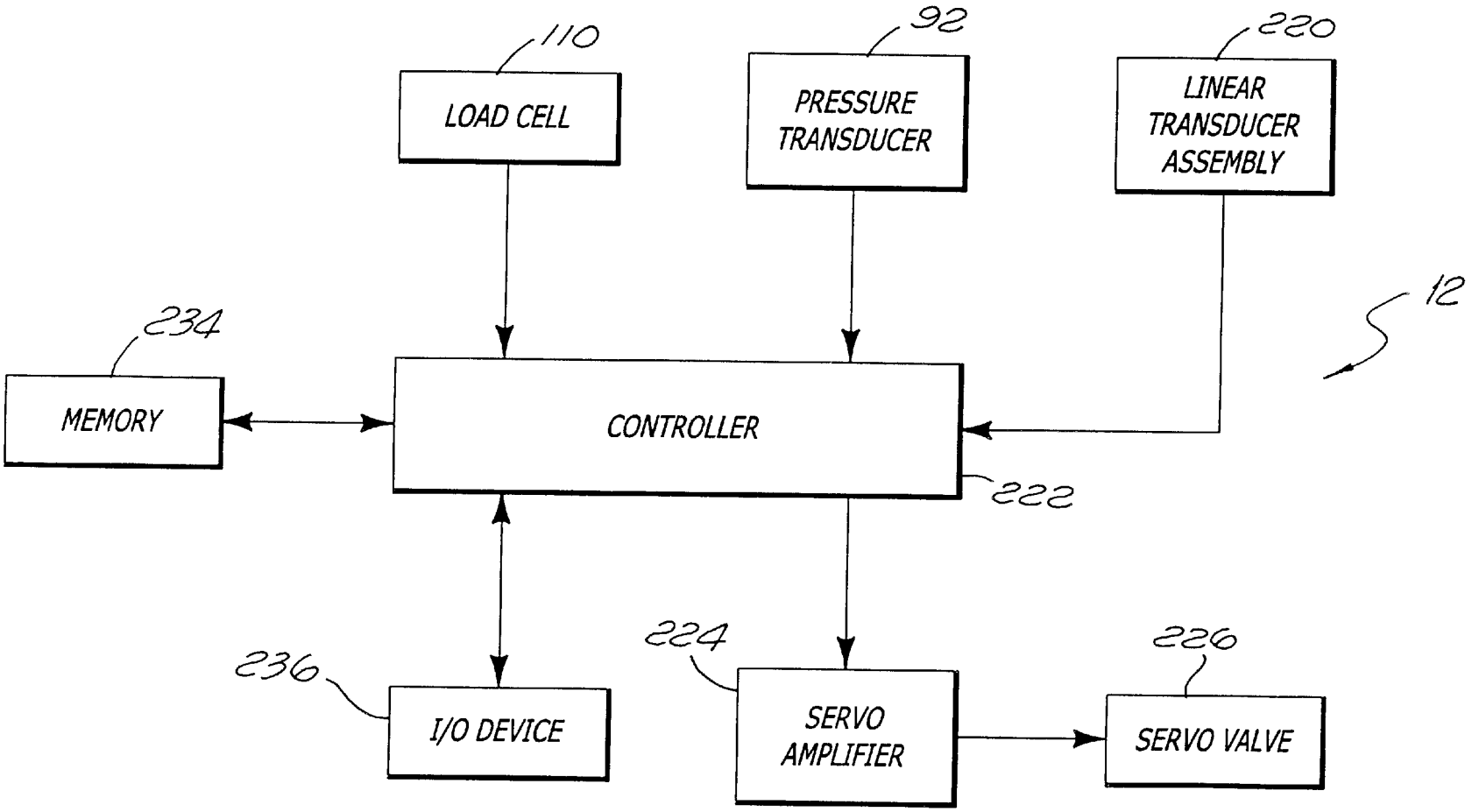
FIG. 6 is a block diagram of a closed loop control system embodying the present invention.

Referring now to FIG. 6, there is shown a block diagram of the components included in the closed loop control system 12 of the present invention. The control system comprises the controller 222, a memory 234 for long term or permanent storage, and the user input/output ("I/O") device 236. The user I/O device includes an interface, such as a display screen 200 (FIGS. 1 through 3), and user controls that are manipulated by the user to input operational data for use by the controller, as described in greater detail below. The user I/O device preferably comprises an alphanumeric keyboard or keypad in a conventional configuration, or other similar devices as are well known in the art.

The special features of the control system 12 of the present invention are implemented, in part, by software programs stored in the memory 234 of the controller 222. The software programs are stored in one or more preselected data files and are accessible by the controller, the function of which is described in greater detail in connection with FIG. 7. The memory preferably takes the form of a non-volatile memory device, such as a magnetic or optical storage unit or the like.

Figure 7:
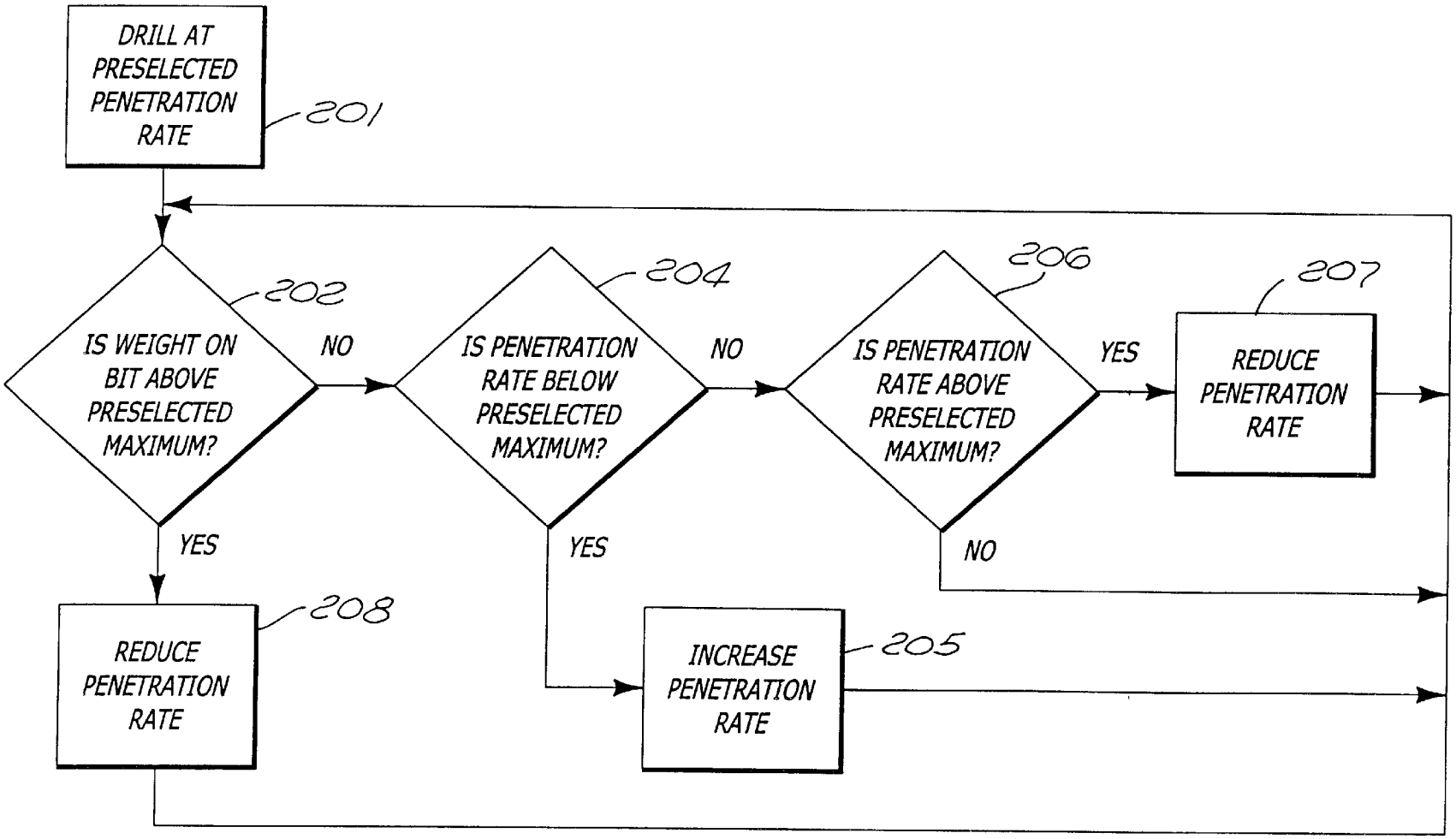
FIG. 7 is a flow chart of the operational flow of the control system of FIG. 6.

Referring now to FIG. 7, the operation of the method and system of the present invention is described in conjunction with the above structural description of the drilling mechanism 10 and control system 12. Before operation begins, the controller prompts the operator for a maximum penetration rate and maximum weight-on-bit. The operator may enter such information through the I/O device 236.

Alternatively, the controller can be pre-programmed with default values for the maximum penetration rate and weight-on-bit. The values are stored in the memory 234. The suspended drill string 101 is weighed while the string is suspended within the hole and that weight is used to calibrate the controller to properly determine weight-on-bit. In addition, if the weight of the drill string is below the set weight-on-bit, then the controller determines that the system must operate in the "pull-down" mode, whereas if the weight of the drill string is above the set weight-on-bit, the controller determines that the system must operate in the "hold back" mode. In one embodiment, a button is included on the control panel 200. When the entire drill string is assembled, and before the drill bit comes into contact with the earth, the operator may depress the button to signal the controller 222 to record the weight signal being generated by the load cell 110. Alternatively, the controller can be programmed to automatically record the weight signal from the load cell immediately prior to the start or continuation of the drilling procedure.

As illustrated in FIG. 7, the operation begins with the drillhead assembly 100 drilling at the preselected maximum rate of penetration, as indicated by function block 201. The controller 222 then determines whether the weight-on-bit is above the preselected maximum weight-on-bit, at query block 202. As described above, in the "pull-down" mode, this is determined by the electrical signal received from the pressure transducer 92, whereas in the "hold back" mode, the signal from the load cell 110 is interpreted by the controller to determine the weight-on-bit. If at query block 202 the weight-on-bit is determined to be below the preselected maximum, operation then flows to query block 204 where the controller determines whether the rate of penetration is below the preselected maximum rate. This is determined by the linear displacement transducer assembly 220, as described above. If so, the controller increases the rate of penetration, at function block 205, and operation flows back to query block 202 to once again monitor the weight-on-bit now that the rate of penetration has been increased. If, at query block 204, the rate of penetration is determined to not be below the preselected maximum rate, then operation flows to query block 206, and the controller determines whether the rate of penetration is above the preselected maximum. If so, then at function block 207 the rate of penetration is reduced, and operation flows back to block 202 to monitor the weight-on-bit. If at block 206, the rate of penetration is not above the maximum allowable rate, operation flows directly back to query block 202 to again monitor the weight-on-bit.

At query block 202, if the weight-on-bit is determined to be above the preselected maximum weight, operation flows to function block 208, and the rate of penetration is reduced. This is accomplished by the controller transmitting an appropriate control signal to the servo amplifier 224, which operates to drive the servo valve 226 to feed the appropriate port of the motors 65, as described above operation then flows back to query block 202 to determine the weight-on-bit after the rate of penetration has been reduced. The controller is programmed to reduce the rate of penetration in predetermined increments in an effort to maintain the most efficient penetration rate while simultaneously ensuring that no damage will come to the drill bit. This routine is repeated until the weight-on-bit is determined to be below the preselected maximum level.

From the above description, it will be apparent that the penetration rate is maintained within an operating window such that the penetration rate is neither too fast nor too slow, as determined by the weight on the drill bit. A rate that is too fast can result in excessive weight-on-bit, while a rate that is too slow can act to polish the diamonds and dull the drill bit. It will be understood that the weight-on-bit or rate of penetration may, for an instant, exceed the preselected maximum values before the rate of penetration is reduced by the servo amplifier 224 and servo valve 226. Thus, it will be apparent that the preselected maximum rate of penetration and weight-on-bit should be chosen at levels slightly below the absolute maximum levels for the particular bit involved. Alternatively, the controller can be programmed to reduce the rate of penetration once the weight-on-bit is within some predetermined range slightly below the maximum allowable weight, rather than begin to reduce the penetration rate only after the weight-on-bit exceeds the preselected threshold.

The controller 222 may be programmed to allow an operator to temporarily increase the maximum value for the weight-on-bit, such as in instances where the drilling stops or slows to a very low rate (i.e., when there is little or no further penetration). The operator can increase the weight-on-bit maximum value through the I/O device 236. However, the weight-on-bit can never be set to exceed the absolute maximum value, which is stored in memory 234.

It will be understood that there are two different states in which the control system 12 of the present invention operates, namely a penetration rate-controlled state, and a weight-controlled state. In the penetration rate-controlled state, the weight-on-bit is below the preselected maximum value, and the controller 222 controls the servo amplifier 224 such that the servo valve 226 is at a setting to maintain the rate of penetration at or close to the maximum rate. As shown in FIG. 7, this corresponds with blocks 204 through 207. This ensures that the penetration rate is maintained within the operating window as described above. In the weight-controlled state, the weight-on-bit is at the maximum level, and the rate of penetration is reduced to keep the weight-on-bit from exceeding the maximum allowable value. This state corresponds with blocks 202 and 209. Thus, in either mode, it will be understood that the rate of penetration is optimized while maintaining the weight-on-bit at or below the preselected maximum value.

It is desirable to maintain the penetration rate below a predetermined maximum rate, regardless of the weight-on-bit. For example, when the drill bit is passing through very soft earth or even voids below the surface, the weight-on-bit will almost certainly be below the maximum weight-on-bit set by the operator, no matter what the rate of penetration is. If the rate of penetration were allowed to increase without limit, the rate could get so high that when the drill bit came into contact with harder earth, the weight-on-bit would instantly become so high that the drill bit and possibly a portion of the drill string would be damaged or destroyed. In addition, when dealing with broken ground, it is desirable to maintain the penetration rate at a relatively low rate to keep the core as intact as possible and to prevent wedging of the core inside the drill.

Furthermore, so long as the weight-on-bit is below the set maximum, it is advantageous to control the penetration rate to maintain it at or near the preselected maximum penetration rate in order to optimize the penetration rate and provide an efficient system. The present invention accomplishes this goal while ensuring that the drill bit is not damaged by having excessive weights applied to it.

By way of example, the maximum weight-on-bit is typically set between 2,000–12,000 pounds, while the maximum penetration rate is set between 5–10 inches per minute. In addition, in relatively hard earth such as granite, the penetration rate at which the maximum weight-22 on-bit is achieved is approximately 0.5–1.0 inch per minute, while in limestone or other relatively soft earth, the penetration rate at which the maximum weight-on-bit is achieved is approximately 10–20 inches per minute.

Figure 8:
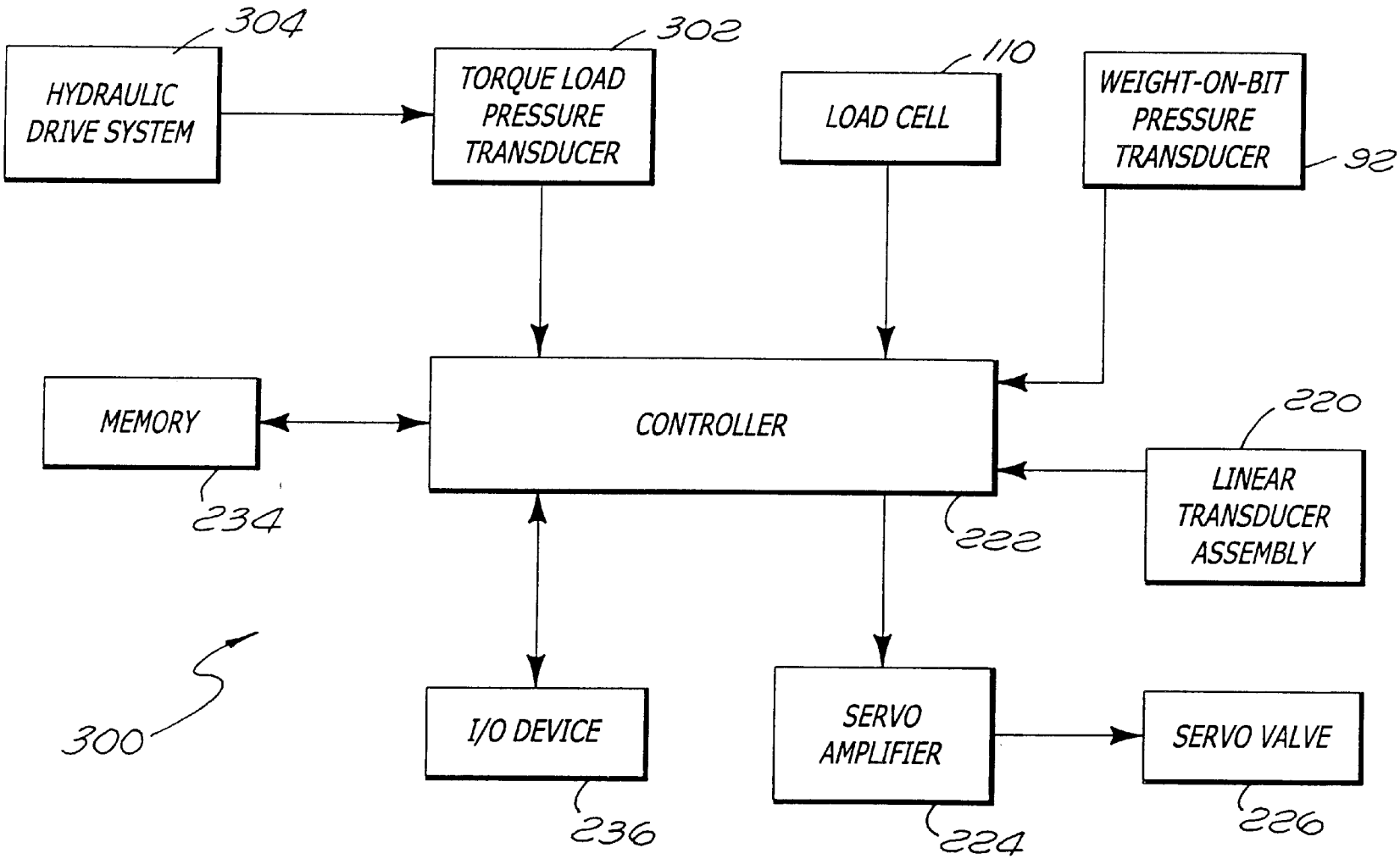
FIG. 8 is a block diagram of another illustrative embodiment of the closed loop control system of the present invention.

Referring now to FIG. 8, there is shown another illustrative embodiment of the closed loop control system 300 according to the present invention. The control system 300 comprises the pressure transducer 92 and load cell 110 which cooperate to sense the weight on the drill bit, as described above. The control system also includes the linear transducer assembly 220 which is operative to monitor the penetration rate of the drill bit, as described above. The system also includes the memory 234, the I/O device 236, servo amplifier 224, servo valve 226, and the controller 222.

In this embodiment, the control system 300 additionally includes a second pressure transducer 302 which determines the torque load being applied to the drill string 101 by sensing the pressure in a hydraulic drive system 304 which drives the hydraulic drive motors that rotate the drill string. As mentioned above, and as set forth in greater detail in co-pending U.S. patent application Ser. No. 08/567,184, assigned to Boart Longyear Company, which is expressly incorporated herein by reference, the hydraulic drive system 304 comprises a drive motor assembly including a pair of conventional hydraulic drive motors that are engaged to the drillhead assembly 100 and operative to rotate the drillhead assembly and thus the drill bit mounted thereon. The torque-sensing pressure transducer 302 is connected for fluid communication with the drive system 304, and is operative to sense the fluid pressure in the hydraulic drive system and to generate a corresponding signal. The controller receives the signal which corresponds with the pressure in the hydraulic system, and from which the torque load applied to the drill string can be determined, as is well known to those skilled in the art.

The memory 234 stores preselected maximum values for the weight on the drill bit, the rate of penetration of the drill bit, and the torque load on the drill string. Thus, the controller receives the signal from the pressure transducer 302, determines the torque load being applied to the drill string, accesses the memory to retrieve the maximum value for the torque load, and compares the sensed torque load value with the preset maximum torque load value.

Figure 9:
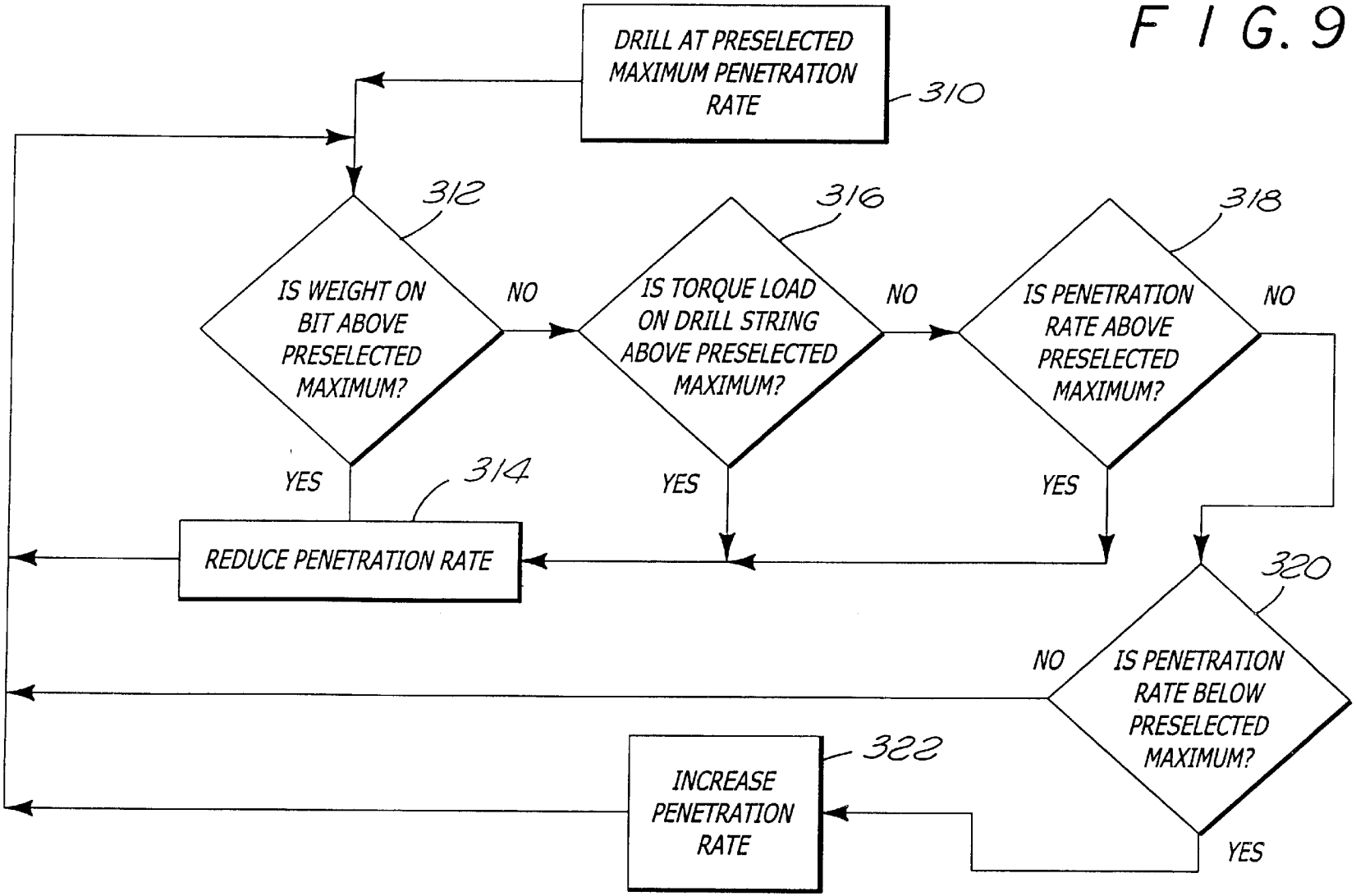
FIG. 9 is a flow chart of the operational flow of the control system of FIG. 8.

Referring to FIG. 9, the operation of the control system 300 is described. Before operation begins, the controller 222 prompts the operator to input penetration rate, torque load, and weight-on-bit maximum values. The operator may enter such information through the I/O device 236. The input data is stored in the memory 234 for future retrieval. If no such values are input, the memory stores default maximum values which are retrieved by the controller 222.

As illustrated in FIG. 9, the drillhead assembly 100 begins drilling at the preselected maximum rate of penetration, as indicated by function block 310. The controller 222 then determines whether the weight-on-bit is above the preselected maximum weight-on-bit value stored in memory 234, at query block 312. As described above, in the "pull-down" mode, this is determined from the electrical signal received from the pressure transducer 92, whereas in the "hold back" mode, the signal from the load cell 110 is used to determine the weight-on-bit. If the weight-on-bit is above the preselected maximum, operation flows to function block 314 and the controller 222 controls the drive assembly to reduce the rate of penetration, which also reduces the weight-on-bit. This is accomplished by means of the controller transmitting an appropriate control signal to the servo amplifier 224, which operates to drive the servo valve 226 to feed the appropriate port of the drive motors 65. Operation then flows back to query block 312.

If, on the other hand, the weight-on-bit is below the preselected maximum weight-on-bit value, operation proceeds to query block 316, and the controller 222 determines whether the torque load being applied to the drill string exceeds the preselected maximum torque load value. As described above, this is accomplished by receiving the pressure signals from the pressure transducer 302 and determining the torque load from the pressure signals. If the torque load exceeds the preset maximum, operation flows to block 314, and the controller controls the drive assembly to reduce the rate of penetration of the drill bit, which reduces the torque load on the drill string, as well as the weight-on-bit.

If the torque load on the drill string is at an acceptable level, operation proceeds to query block 318 and the controller determines whether the rate of penetration is above the preset maximum, by comparing the signal from the linear displacement transducer with the maximum value stored in memory 234. If the rate of penetration exceeds the preset maximum, the controller controls the drive assembly to reduce the rate of penetration, at block 314, and operation then proceeds back to query block 312, and the process is repeated.

If the rate of penetration does not exceed the preset maximum, the controller then determines whether the penetration rate is below the preset maximum, at step 320. If so, the controller controls the drive assembly to increase the rate of penetration, at step 322, and operation then proceeds back to step 312. By increasing the rate of penetration, the weight-on-bit and torque load will likely increase. Thus, the process is repeated to ensure that neither the weight-on-bit or torque load now exceed their respective maxima after increasing the penetration rate. If, on the other hand, at step 320 the controller 222 determines that the actual rate of penetration being sensed is equal to the preset maximum penetration rate, then the rate of penetration remains unchanged, and operation flows back to step 312 to repeat the process.

In this manner, the system 300 maintains the weight-on-bit, torque load, and rate of penetration within preselected maxima, while simultaneously maximizing the rate of penetration to optimize the performance of the device.

From the foregoing, it will be apparent that the closed loop control system of the present invention provides a reliable system that automatically reduces the penetration rate of a drill bit in the event the weight on the drill bit exceeds a preselected maximum value. In addition, the system continually monitors the weight on the bit and the penetration rate and maximizes the penetration rate while keeping the weight on the bit below the preselected maximum value. Furthermore, the system ensures that the torque load applied to the drill string is maintained within acceptable levels, while simultaneously optimizing the rate of penetration of the drill bit.

While forms of the invention have been illustrated and described, it will be apparent to those skilled in the art that various modifications and improvements may be made without departing from the spirit and scope of the invention. As such, it is not intended that the invention be limited, except as by the appended claims.

What is claimed is:

1. A control system for controlling operation of a core drilling device, the core drilling device including a drive system to advance and retract a drill string carrying a drill bit, the control system comprising:

a first sensor in communication with the core drilling device, the first sensor being operative to sense a weight on the drill bit during a pull-down mode of operation, and to generate a corresponding first signal;

a second sensor in communication with the core drilling device, the second sensor being operative to sense the weight on the drill bit during a hold-back mode of operation, and to generate a corresponding second signal; and a controller in electrical communication with the respective sensors and with the drive system, the controller being programmed with a preselected maximum value for the weight on the drill bit, wherein the controller is responsive to one of the signals having a value above the respective maximum value to control the drive system to reduce the rate of penetration of the drill bit.

2. The control system of claim 1, wherein the first sensor comprises a pressure transducer.

3. The control system of claim 1, wherein the second sensor comprises a load cell.

4. The control system of claim 1, wherein the controller is responsive to the respective signals having values corresponding to a weight on bit below the maximum value to control the drive system to increase the rate of penetration of the drill bit.

5. The control system of claim 1, wherein the drive system includes a hydraulic circuit comprising one or more hydraulic motors connected to the drill string, the hydraulic circuit further including a servo valve, the controller being electrically connected for communication with the servo valve to control the drive system.

6. The control system of claim 1, wherein the controller comprises a programmable logic controller.

7. The control system of claim 1, further including a third sensor that is operative to sense the rate of penetration of the drill string and to generate a corresponding signal, and wherein the controller is responsive to receipt of signals from the respective sensors that each have a value below the respective maximum values to control the drive system to increase the rate of penetration.

8. The control system of claim 1 and further including an input device to allow an operator to input a weight-on-bit maximum value, and wherein the controller is electrically connected to the input device and is responsive to input of a new value to modify the maximum value.

9. A method of controlling weight on a drill bit, the drill bit being carried by a drill string and driven by a drilling device, the method comprising:

providing first and second sensors for sensing the weight on the drill bit, wherein the first sensor is operative to sense the weight on bit during a pull-down mode of operation and to generate a corresponding first signal, and wherein the second sensor is operative to sense the weight on bit during a hold-back mode of operation and to generate a corresponding second signal;

monitoring the first sensor during the pull-down mode;

monitoring the second sensor during the hold-back mode;

determining whether the sensed weight on bit exceeds a preselected maximum value for the weight on the drill bit; and reducing the rate of penetration of the drill string if the sensed weight exceeds the preselected maximum value.

10. The method of claim 9 and further including the steps of:

providing a sensor that is operative to sense the rate of penetration of the drill string;

determining whether the sensed rate of penetration is below a preselected threshold value for the rate of penetration;

determining whether the weight on bit is below the preselected maximum value, if the sensed rate of penetration is below the preselected threshold value; and increasing the rate of penetration if the weight on bit is below the preselected maximum value.

* * * * *